US005183207A

United States Patent [19]

Steinberg et al.

[11] Patent Number: 5,183,207

[45] Date of Patent: Feb. 2, 1993

[54] AIR SEAL FOR PAINT GUNS

[75] Inventors: Timothy D. Steinberg, Coon Rapids; Richard W. Gunderson, Elk River, both of Minn.

[73] Assignee: Wagner Spray Tech Corporation, Minneapolis, Minn.

[21] Appl. No.: 792,175

[22] Filed: Nov. 14, 1991

[51] Int. Cl.[5] ..... B05B 7/02; B05B 1/28

[52] U.S. Cl. ..... 239/526; 239/296; 239/DIG. 14; 277/178

[58] Field of Search ..... 277/178, 186, 212 F; 239/526, 527, 528, 296, DIG. 14, 583, 297, 300

[56] References Cited

U.S. PATENT DOCUMENTS

| | | | |
|---|---|---|---|
| 484,318 | 10/1892 | Howell | 277/178 |
| 2,039,009 | 4/1936 | Lampman et al. | 277/178 |
| 2,708,095 | 5/1955 | Mitchell | 239/300 |
| 2,768,012 | 10/1956 | Klingler | 277/178 |
| 2,829,006 | 4/1958 | Johansson | 239/526 |
| 2,897,533 | 8/1959 | Bull et al. | 277/178 |
| 3,123,337 | 3/1964 | Peras | 251/333 |
| 3,518,359 | 6/1970 | Trimble et al. | 277/178 |
| 3,995,332 | 1/1976 | Forchini et al. | 277/178 |
| 4,154,403 | 5/1979 | Forrester | 239/528 |
| 4,172,599 | 10/1979 | Forch | 277/186 |
| 4,560,109 | 12/1985 | Teruyuki et al. | 239/583 |
| 4,744,571 | 5/1988 | Geberth | 277/208 |
| 5,050,804 | 9/1991 | Svendsen et al. | 239/296 |
| 5,078,322 | 1/1992 | Torntore | 239/527 |
| 5,078,323 | 1/1992 | Frank | 239/528 |

*Primary Examiner*—Andres Kashnikow
*Assistant Examiner*—Christopher G. Trainor
*Attorney, Agent, or Firm*—Faegre & Benson

[57] ABSTRACT

An improved shaft sealing ring for a portable paint gun of the type having an axially movable control shaft for controlling a supply of pressurized air to atomize a stream of paint. The sealing ring has a truncated frustroconical surface tapering from a radially extending retaining surface toward a front end of the sealing ring and a radially extending flange at a back end of the sealing ring with an outer peripheral groove in an outer surface of the ring body between the flange and the retaining surface. The ring is installed by urging the front face through an opening having a diameter smaller than that of the face, the opening defined by a wall extending radially inwardly as a part of the gun housing. The flange is resiliently deflected to form a seal when the ring is installed. A central bore of the seal is sized to receive the shaft with a seal between the shaft and the ring provided by a ridge extending radially into the bore of the ring at the back end thereof. The ridge is urged against the shaft by deflection of the flange, thus improving the seal between the ring and the shaft.

15 Claims, 3 Drawing Sheets

AIR SEAL FOR PAINT GUNS

BACKGROUND OF THE INVENTION

This invention relates to the field of portable painting equipment, more particularly to portable paint guns referred to as high volume low pressure or HVLP type paint guns. The invention specifically concerns an air seal for an axially movable control shaft extending through a housing of the paint gun. The present invention achieves a nearly airtight seal between the shaft and the seal and between the seal and the spray gun housing. In addition, the seal can accommodate a certain amount of radial misalignment without impairing the sealing function.

In the past, a bushing (which was not designed to be) was used to guide the shaft in its axial motion. Such a bushing allowed a substantial air flow along the shaft, degrading gun performance and, in some cases, allowing a tactilely perceptible (and thus objectionable) flow to impinge on an operator's hand. The present invention overcomes these disadvantages of the prior art while continuing to provide the guiding function.

DETAILED DESCRIPTION

Figure 1:
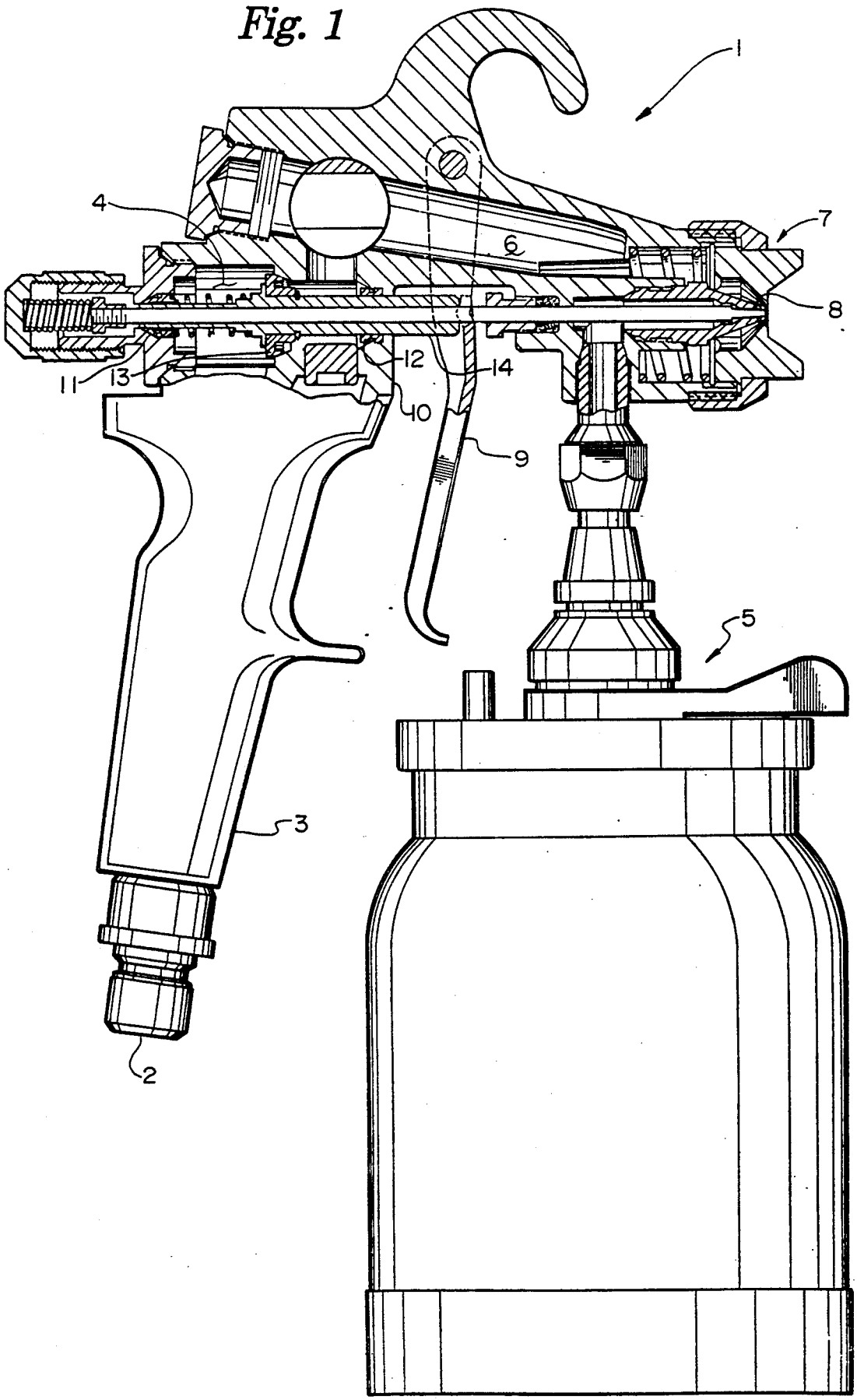
FIG. 1 is a side view, partly in section, of a paint gun suitable for the practice of the present invention.

Referring now to FIG. 1, a paint gun 1 useful in the practice of this invention may be seen. Paint gun 1 is a high volume, low pressure type, useful with an air pressure source of about 10 psi. In this type of gun, air enters fitting 2, passes through handle 3 and into chamber 4. When trigger 9 is depressed, control shaft 14 opens air valve 13 permitting air to travel through passageway 6 to air cap 7 to atomize paint drawn from cup 5 and released by paint valve 8. It is to be understood that trigger 9 and control shaft 14 control both air valve 13 and paint valve 8. When trigger 9 is released, air valve 13 is closed, and it is desired to eliminate or at least minimize leakage of air from the interior of gun body or housing 10. This may be accomplished by a rear seal 11. When trigger 9 is depressed, it is desired to minimize air leakage between shaft 14 and housing 10; this is accomplished by the present invention of a front air seal 12 which overcomes limitations of the prior art.

Figure 3:
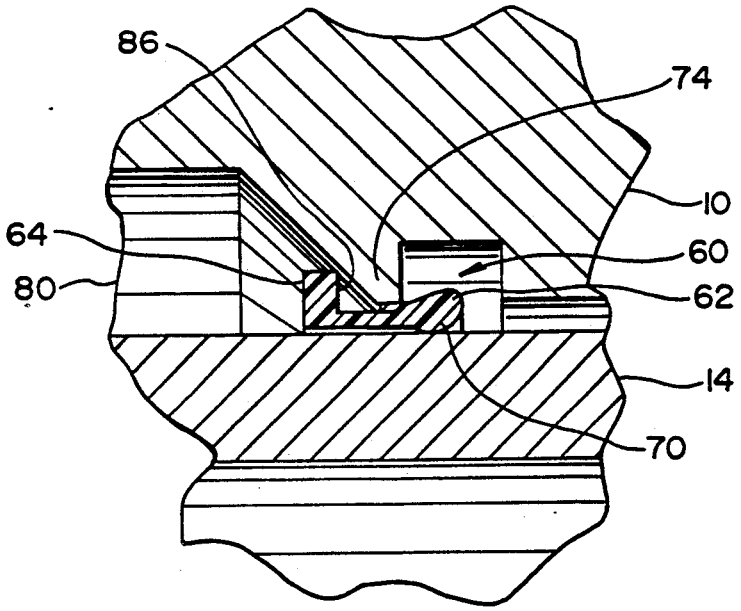
Fig. 3 PRIOR ART
FIG. 3 is a section view of the prior art bushing positioned around a control shaft and retained in the gun body of FIG. 1 and showing the bushing as typically deformed when installed.
Figure 2:
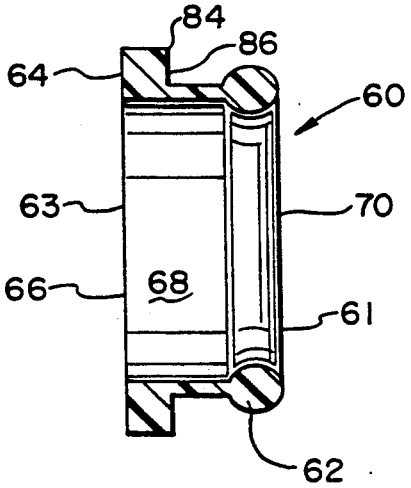
Fig. 2 PRIOR ART
FIG. 2 is an enlarged side section view of a prior art bushing.

Referring to the drawings and more particularly to FIGS. 2 and 3, a prior art bushing 60 may be seen. The bushing 60 is generally cylindrical and has a central opening or lumen 66, a rounded retaining collar 62 disposed at a proximal end 61 of the bushing 60, and a radially extending backstop 64 at a distal end 63 of the bushing 60. An inside surface 68 of the lumen 66 has a rounded inwardly extending restriction 70 at the proximal end 61 of the bushing 60 to engage a control shaft 14 with "matched diameter" fit. By "matched diameter" is meant that the outside dimension of the shaft 14 equals the inside diameter of restriction 70.

The collar 62 of the prior art bushing 60 was inwardly compressed and has been observed to be permanently deformed (as shown in FIG. 3) after it was installed in housing 10. Once installed, the bushing 60 was retained against axial movement by the wall 74 when shaft 14 moved in response to movement of the trigger. A typical example of permanent deformation of the collar 62 is shown in FIG. 3. However, bushing 60 did not appreciably block air leakage from between shaft 14 and housing 10. Even when an outer perimeter 84 of a forward face 86 of the backstop 64 of bushing 60 contacted the wall 74, such contact was found insufficient to reliably block air leakage. In addition, in such a prior art configuration, the backstop 64 and the collar 62 were not designed to urge the backstop 64 against the wall 74 when the bushing 60 was installed.

Figure 4:
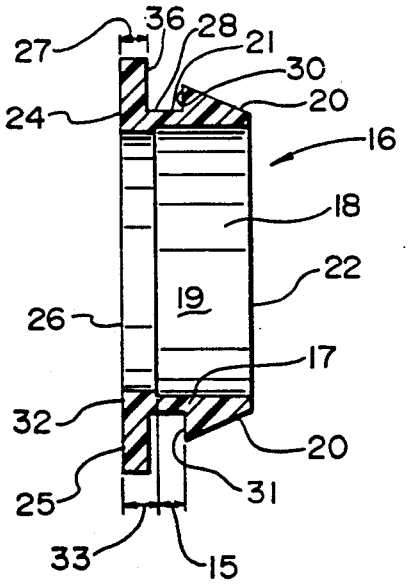
FIG. 4 is an enlarged side section view of the sealing ring of the present invention in a relaxed state.
Figure 6:
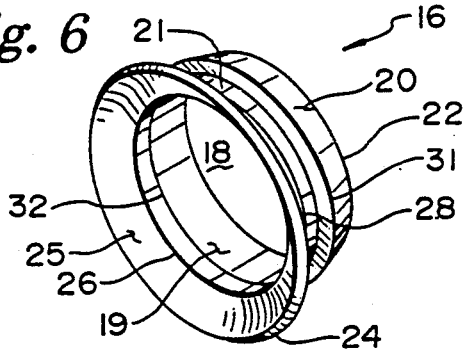
FIG. 6 is a perspective view of the sealing ring of the present invention in the deflected state as it would appear when installed.
Figure 5:
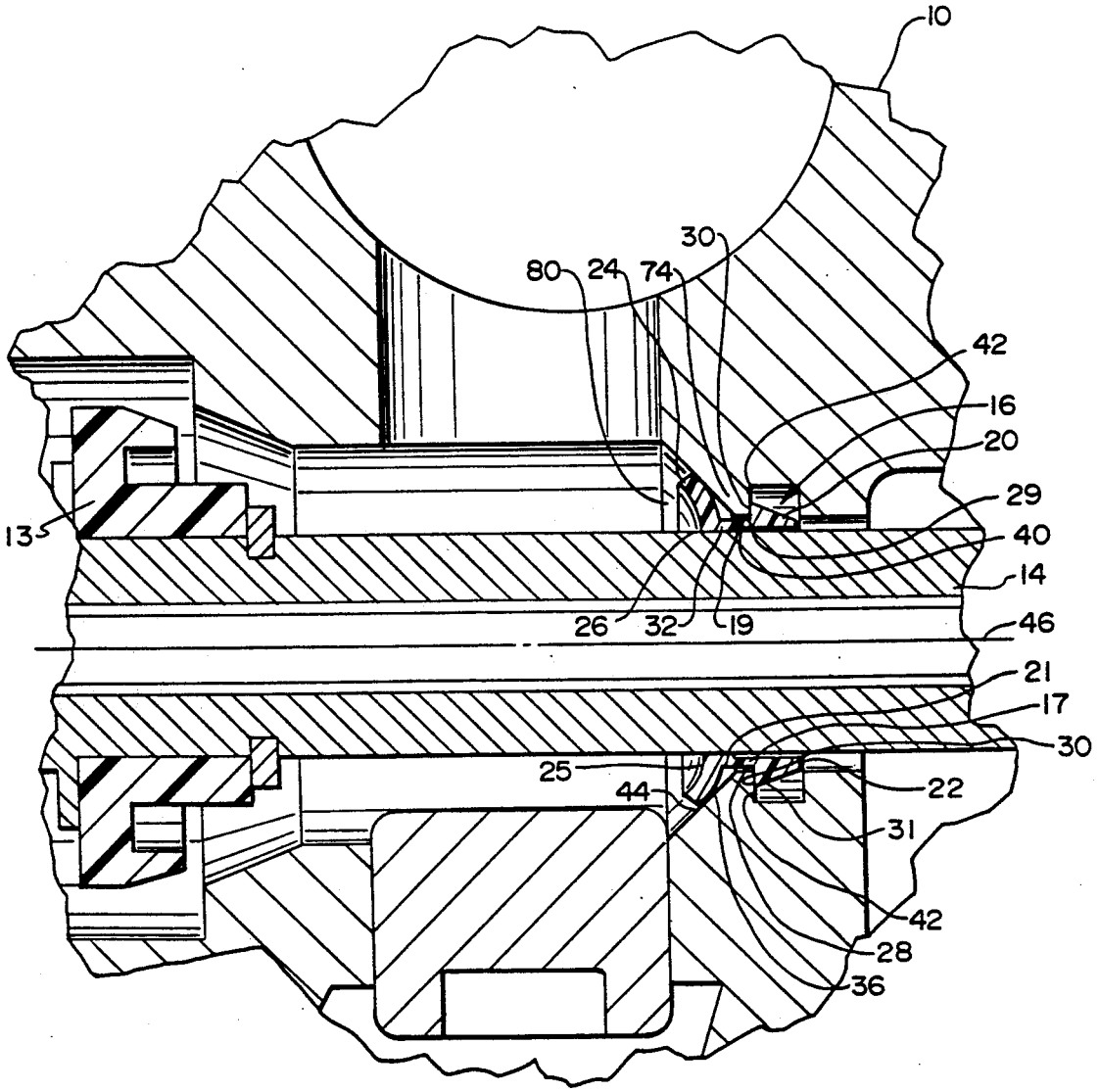
FIG. 5 is an enlarged side section view of the sealing ring of the present invention positioned around the control shaft and retained in the gun body of the type shown in FIG. 1 and illustrating the sealing ring as it appears when installed.

The present invention, as shown in FIGS. 4, 5 and 6, utilizes a sealing ring 16 to minimize passage of air past the axially movable valve control shaft 14 (which operates control valve 13) in the portable paint spray gun 1. In addition, the sealing ring 16 axially guides shaft 14.

As is most clearly shown in FIG. 4 in its relaxed state, sealing ring 16 has a generally cylindrical body 17 with a front end 22, a back end 26, an outer surface 21 and a central bore 18 having an internal surface 19. A resilient flange 24 extends radially from the outer surface 21 of body 17 at the back end 26. Intermediate the front and rear ends 22 of the body 17, a retaining surface 30 extends radially outwardly from the outer surface 21.

A circumferential groove 28 is defined on the outer surface 21 of body 17 by flange 24 and retaining surface 30. The groove 28 extends a predetermined distance 15 between the retaining surface 30 and a front surface 36 of flange 24. Ring 16 also preferably has an annular ridge extending radially inward from surface 19 of bore 18. As may be seen most clearly in FIG. 4, ridge 32 preferably has a width 33 slightly larger than a width 27 of flange 24. Ring 16 also preferably frustro-conical face 20 between retaining surface 30 and front end 22 of ring 16.

For installation, sealing ring 16 is placed on shaft 14 and pressed into housing 10. Frustro-shaped face 20 and gap 29 facilitate insertion of ring 16 through the opening 40 without substantial permanent deformation of the face 20 or surface 30. Since opening 40 preferably has a smaller diameter than the outside diameter of retaining surface 30, portion 20 of ring 16 is resiliently and temporarily compressed as it passes through the opening 40 in wall 74. Upon passing the opening 40, the portion 20 expands and ring 16 is retained within housing 10 by surface 30 abutting the forward surface 42.

The sealing ring 16 is preferably formed of a resilient material such as low density polyethylene which has been found to be acceptable because of its resistance to both hardening and deterioration upon exposure to solvents used for cleaning.

Referring now most particularly to FIG. 5, after ring 16 is installed in housing 10, retaining surface 30 is held by a forward surface 42 of wall 74 extending radially inwardly into chamber 80 and the front face 36 of flange 24 contacts an infundibular or funnel-shaped rear surface 44 of wall 74 of housing 10. Housing 10 is preferably but not necessarily formed of aluminum. The groove 28 is positioned radially interior a generally central opening 40 defined by wall 74. As shown in FIG. 5, the width 15 of groove 28 and thickness of wall 74 are sized to resiliently deflect flange 24 against the rear surface 44 when retaining surface 30 is held by the forward surface 42 of the wall 74. Moreover, the groove 28 preferably has a diameter sized slightly less than the diameter of the opening 40 to allow a gap 29 between the groove 28 and housing 10. The gap 29 permits the sealing ring 16 to contact surface 44 of housing 10 even if there is some eccentricity between shaft 14 and opening 40 or if there are slight variations or irregularities in the diameter of the opening 40.

In the practice of this invention, resilient deflection of flange 24 against wall 74 of housing 10 creates a first seal between surface 36 of ring 16 and surface 44 of wall 74. The first seal is enhanced or reinforced by air pressure directed against a back face 25 of the flange 24 during operation of the spray gun when valve 13 is open.

It is to be understood that the retaining surface 30 is preferably an unbroken annular surface which is held against the forward surface 42 of wall 74 to create a second seal between sealing ring 16 and housing 10. The second seal is preferably, but not necessarily, achieved by having both surfaces 30 and 42 perpendicular to a central axis 46.

A third seal is provided by annular ridge 32 engaging shaft 14 preferably in an interference fit. Deformation of flange 24 against surface 44 also urges the annular ridge 32 against the shaft 14, which enhances the third seal (which is between the sealing ring 16 and the shaft 14). In practice, with a diameter of shaft 14 at 0.330" it has been found preferable to make the inside-diameter of ridge 32 is 0.320".

Referring now to FIG. 6, ring 16 may be seen in a perspective view as it would appear when installed. In this condition, ring 16 has flange 24 deflected into a generally cup-shaped surface (on surface 36), thus providing a reliable seal between surface 36 and housing 10.

As used herein, the term "seal" is to be understood to not imply that an absolutely airtight or hermetic seal is achieved. Rather, it is to be understood that an effective air seal is achieved by the sealing ring of the present invention, the benefits of which may be observed by submerging all but the air cap of a gun containing the present invention under water and actuating the trigger and observing leakage along the control shaft. Prior to the present invention, a continuous air leakage had been observed; with the present invention, it has been observed that air leakage along the control shaft is reduced to a range of zero to approximately two bubbles per second.

The invention is not to be taken as limited to all of the details thereof as modifications and variations thereof may be made without departing from the spirit or scope of the invention.

What is claimed is:

1. In a portable paint gun of the type having a housing with a passage containing a control valve mounted on an axially movable shaft for controlling pressurized air to atomize a stream of paint, an improved sealing ring in combination therewith comprising:

the paint gun housing having a chamber carrying a control shaft and a radially inwardly extending wall at one end of the chamber; and b) a sealing ring interposed between the control shaft and the radially inwardly extending housing wall, the sealing ring having:

i. a generally cylindrical body having a front end, a back end, and an internal surface forming a central bore, ii. a retaining surface extending radially outwardly from the body and located intermediate the front and rear ends, the retaining surface retained by a first radially inwardly extending surface of the paint gun housing wall, and iii. a generally radially outwardly extending resilient flange located at the back end of the body a predetermined distance from the retaining surface, such that the flange and the retaining surface define a peripheral groove therebetween on an outer surface of the body, and wherein the flange is resiliently deflected by and seals against a second radially inwardly extending surface of the paint gun housing wall when the sealing ring is retained in the paint gun housing.

2. The sealing ring and paint gun combination of claim 1 wherein the sealing ring further comprises a frusto-conical face extending from the retaining surface toward the front end of the body.

3. The sealing ring and paint gun combination of claim 1 wherein the sealing ring is formed of low density polyethylene.

4. The sealing ring and paint gun combination of claim 3 wherein the gun body is formed of aluminum.

5. The sealing ring and paint gun combination of claim 1 wherein the sealing ring further comprises a radially inwardly extending annular ridge at the back end of the body engaging the control shaft in an interference fit.

6. The sealing ring and paint gun combination of claim 1 wherein the flange comprises a generally cup-shaped surface when the sealing ring is installed in the gun housing.

7. A method for sealing a passage in a paint gun of the type having a housing containing a control valve mounted on an axially movable shaft for controlling a supply of pressurized air to atomize a stream of paint, the method comprising the steps of:

a) inserting a sealing ring into the passage in the paint gun housing, the sealing ring having first and second radially outwardly extending, axially opposed surfaces defining a groove therebetween;

b) moving the first radially outwardly extending surface past a radially inwardly extending wall of the paint gun housing defining an opening having a smaller diameter than an outer diameter of the first radially outwardly extending surface such that the sealing ring is retained in the housing;

c) resiliently deflecting a radially outwardly extending flange on the sealing ring against a radially inwardly extending surface of the gun housing wall such that the flange seals against the surface of the wall; and d) inserting the shaft axially through a central bore of the sealing ring in an interference fit such that the shaft seals against the internal surface of the central bore.

8. The method of claim 7 wherein the inwardly extending surface of the gun housing wall comprises a cone-shaped surface.

9. The method of claim 8 wherein step b) further comprises providing a continuous circumferential contact between the flange of the sealing ring and the cone-shaped surface of the gun housing.

10. The method of claim 8 wherein the flange of the sealing ring deflects to form a cup-shaped surface upon installation in the gun housing.

11. The method of claim 7 wherein the sealing ring is formed of low density polyethylene.

12. The method of claim 7 wherein the interference fit between the shaft and the ring is formed by an annular ridge extending inwardly from the internal surface of the central bore and located at the back end of the sealing ring.

13. The method of claim 12 wherein the annular ridge is further urged against the shaft by deflection of the flange.

14. The method of claim 7 wherein the sealing ring further comprises a frustro-shaped face tapering from an outer perimeter of the retaining surface toward the front end.

15. The method of claim 7 wherein step b) further comprises placing the first outwardly extending surface of the sealing ring in continuous circumferential contact with the radially inwardly extending wall of the paint gun such that a seal is formed therebetween.

* * * * *